US008662617B2

(12) United States Patent
Hibino

(10) Patent No.: US 8,662,617 B2
(45) Date of Patent: Mar. 4, 2014

(54) LIQUID EJECTION APPARATUS

(75) Inventor: Tomoko Hibino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1 day.

(21) Appl. No.: 13/596,948

(22) Filed: Aug. 28, 2012

(65) Prior Publication Data

US 2013/0083109 A1 Apr. 4, 2013

(30) Foreign Application Priority Data

Sep. 30, 2011 (JP) ..... 2011-217387

(51) Int. Cl.
*B41J 2/07* (2006.01)
*B41J 2/045* (2006.01)

(52) U.S. Cl.
USPC ..... 347/14; 347/19

(58) Field of Classification Search
USPC ..... 347/5, 9, 10, 11, 12, 13, 14, 19
See application file for complete search history.

(56) References Cited

U.S. PATENT DOCUMENTS

2011/0205273 A1* 8/2011 Hibino ..... 347/10

FOREIGN PATENT DOCUMENTS

JP 2009-066948 A 4/2009
JP 2009-184291 A 8/2009

OTHER PUBLICATIONS

Computer-generated translation of JP 2009-066948, published on Apr. 2009.*

* cited by examiner

*Primary Examiner* — Huan Tran
(74) *Attorney, Agent, or Firm* — Baker Botts L.L.P.

(57) ABSTRACT

A liquid ejection apparatus includes: a passage unit, a piezoelectric actuator, a drive signal generator, a driver, a voltage value changing unit, and an interval setting unit. The piezoelectric actuator applies energy to liquid in the passage unit. The drive signal generator generates a drive signal to be supplied to the piezoelectric actuator, based on a reference voltage value. The driver supplies the drive signal generated by the drive signal generator to the piezoelectric actuator. The voltage value changing unit changes the reference voltage value to a larger voltage value every time an accumulated time during which a voltage is applied between electrodes of the piezoelectric actuator satisfies a predetermined condition. The interval setting unit determines a new time interval to a next change of the reference voltage so that the new time interval is shorter than before, every time the reference voltage value is changed.

7 Claims, 10 Drawing Sheets

LIQUID EJECTION APPARATUS

CROSS REFERENCE TO RELATED APPLICATION

The present application claims priority from Japanese Patent Application No. 2011-217387, which was filed on Sep. 30, 2011 the disclosure of which is herein incorporated by reference in its entirety.

BACKGROUND OF THE INVENTION

1. Field of the Invention

The present invention relates to a liquid ejection apparatus including a piezoelectric actuator having electrodes which sandwich a piezoelectric layer therebetween.

2. Description of the Related Art

There has been known a piezoelectric actuator which is configured to apply an electric field to a piezoelectric layer to deform it, thereby applying energy to liquid such as ink in a supply passage. In such a piezoelectric actuator, an amount of liquid droplets ejected is possibly changed due to age deterioration of deformation properties. One of measures to deal with this is to change a voltage of a drive signal supplied to the piezoelectric actuator to a higher voltage, depending on the number of ejections of liquid droplets. The voltage of the drive signal is thus increased corresponding to the deterioration of the piezoelectric actuator, and with this, a decrease in the degree of deformation of the piezoelectric actuator is compensated.

SUMMARY OF THE INVENTION

According to the knowledge of the present inventor, the degree of deterioration of the piezoelectric actuator depends on: (1) an accumulated time during which an electric field is applied to the piezoelectric layer; and (2) an intensity of the electric field applied thereto. Therefore, when the voltage applied between the electrodes is changed to a higher voltage, this also causes the intensity of the electric field applied to the piezoelectric layer to be increased, and as a result, the deterioration is accelerated. Without taking this into consideration, there may arise a problem that the voltage is not changed at a suitable timing and it is not possible to keep pace with the deterioration of the piezoelectric layer.

An object of the present invention is to provide a liquid ejection apparatus in which a voltage value of a drive signal is changed taking into consideration that there is a variation in the speed of deterioration of the piezoelectric layer.

According to the present invention, provided is a liquid ejection apparatus including: a passage unit including an ejection opening which ejects liquid, and a supply passage which supplies the liquid to the ejection opening; an piezoelectric actuator which includes a first electrode, a piezoelectric layer, and a second electrode arranged so that the first electrode and second electrode sandwich the piezoelectric layer therebetween, the piezoelectric actuator being configured so that, when a drive signal is applied between the first electrode and the second electrode, the piezoelectric layer is deformed and thereby energy is applied to the liquid in the supply passage; a drive signal generator which generates a drive signal having a voltage value corresponding to a reference voltage value; a driver which applies the drive signal generated by the drive signal generator between the first electrode and the second electrode; a voltage value changing unit which changes the reference voltage value; and an interval setting unit which determines a time interval to a change of the reference voltage value made by the voltage value changing unit; in which liquid ejection apparatus, the voltage value changing unit changes the reference voltage value from a present voltage value to a larger voltage value, when an accumulated time during which a voltage is applied between the first electrode and the second electrode, the accumulated time being calculated since a last change of the reference voltage, reaches the time interval determined by the interval setting unit; and when the voltage value changing unit changes the reference voltage value, the interval setting unit determines another time interval which is shorter than before, based on the larger voltage value.

DESCRIPTION OF THE PREFERRED EMBODIMENTS

Figure 1:
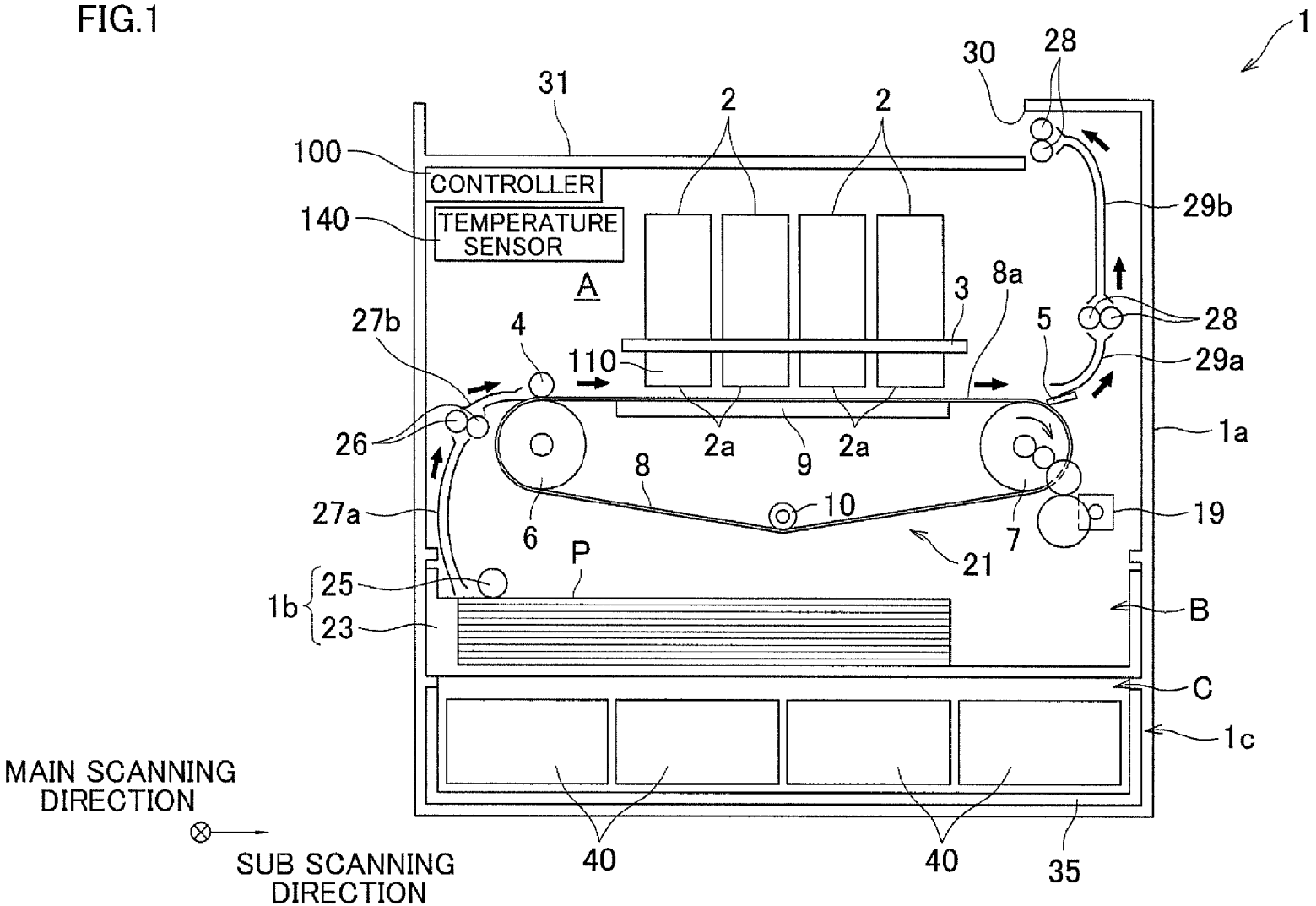
FIG. 1 is a schematic side view showing an internal structure of an ink jetprinter to which ink-jet heads related to one embodiment of the present invention are applied.

The following describes a preferred embodiment of the present invention with reference to the drawings.

First, referring to FIG. 1, description will be given for an overall structure of an ink-jet printer 1 related to one embodiment of the present invention.

The printer 1 has a housing 1*a* of rectangular parallelepiped shape. A discharged paper receiver 31 is provided on a top panel of the housing 1*a*. In the following description, an internal space of the housing 1*a* is divided into spaces A, B, and C in this order from the top. In the spaces A and B, there is formed a sheet conveyance path continuing to the discharged paper receiver 31. In the space A, a sheet P is conveyed and an image is recorded on the sheet P. In the space B, operations related to paper feeding are carried out. In the space C, ink cartridges 40 each serving as an ink supply source are contained.

In the space A, there are disposed: four ink-jet heads 2 (hereinafter, referred to as heads 2); a conveyor unit 21 which conveys a sheet P; a guide unit which guides the sheet P; and the like. In the space A, there is also disposed a controller 100 which controls an operation of each unit of the printer 1, including each of the above-mentioned mechanisms, and thereby administrates the whole operations of the printer 1. Further, there is provided a temperature sensor 140 (thermometer) which detects an ambient temperature in the printer 1.

The controller 100 controls the following operations of: preparation related to recording; feed, conveyance, and discharge of a sheet P; ejection of ink in synchronization with the conveyance of the sheet P; and the like, so that an image is recorded on the sheet P based on image data supplied from the outside.

Figure 6:
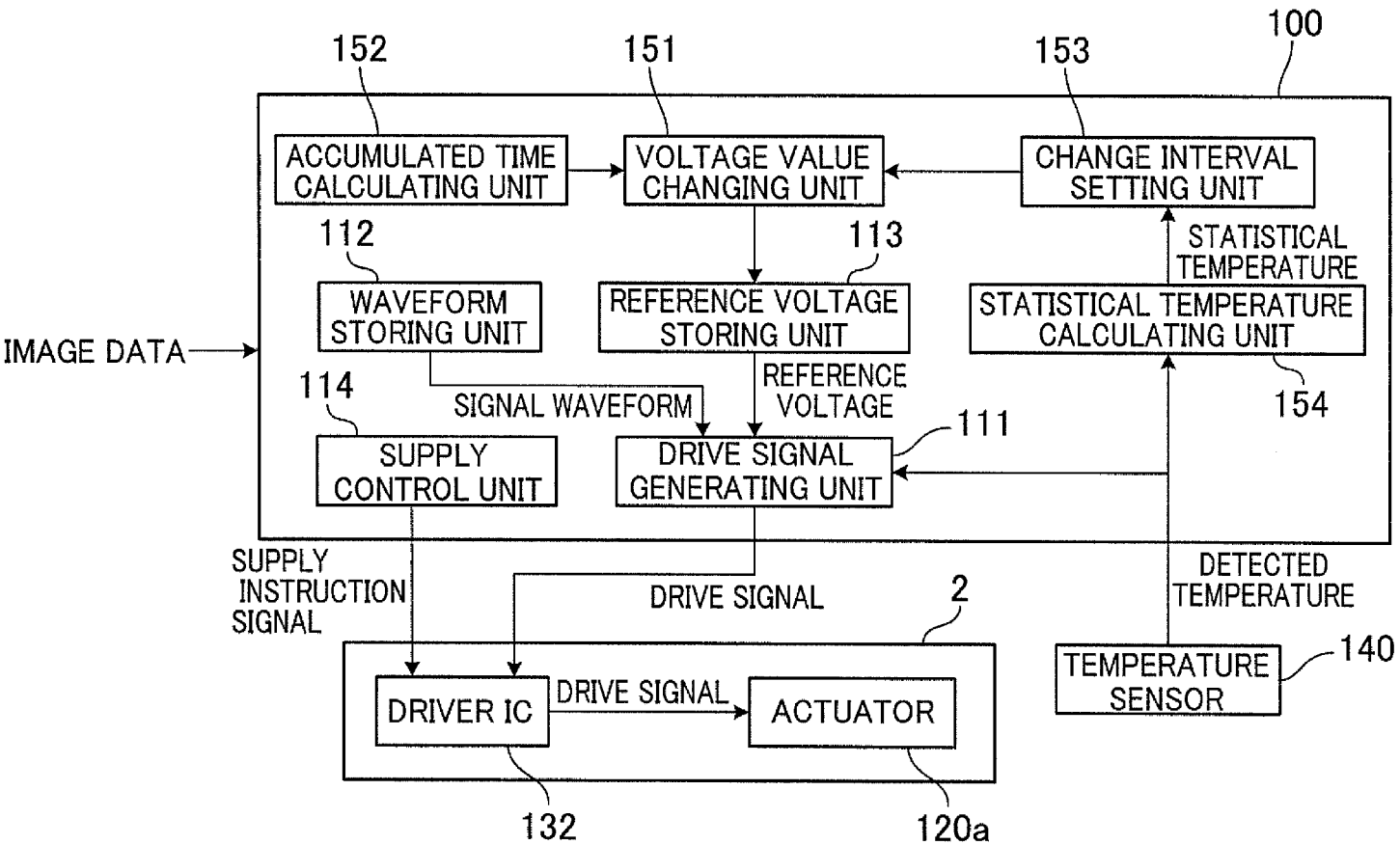
FIG. 6 is a block diagram showing a structure of a control system.

The controller 100 includes, in addition to a CPU (Central Processing Unit), a ROM (Read Only Memory), a RAM (Random Access Memory: including a non-volatile RAM), an ASIC (Application Specific Integrated Circuit), an I/F (Interface), an I/O (Input/Output Port), and the like. The ROM stores therein: programs executed by the CPU; various fixed data; and the like. The RAM temporarily stores therein data needed at the time of execution of a program. The above data includes image data. In the ASIC, signal processing related to the image data, image processing, and the like are carried out. The I/F performs data communication with a higher-level device. The I/O inputs/outputs detection signals of various sensors. The later-described structure of a control system shown in FIG. 6 is constituted by these hardware and software stored in the ROM and the like, which are in cooperation with one another. Alternatively, there may be provided a circuit or the like exclusively specialized for the function of each function unit shown in FIG. 6, if needed.

Each head 2 is a line head which is long in a main scanning direction and has a substantially rectangular parallelepiped shape. The four heads 2 are arranged in a sub scanning direction at predetermined pitches, and supported by the housing 1*a* via a head frame 3. Each head 2 includes a passage unit 12 and eight actuator units 120 (see FIG. 2). At the time of recording an image, magenta, cyan, yellow, and black inks are respectively ejected from under surfaces of the respective four heads 2. Hereinafter, the under surface of each head 2 is referred to as an ejection surface 2*a*. More specific structure of each head 2 will be described later in detail.

As shown in FIG. 1, the conveyor unit 21 includes: belt rollers 6 and 7; an endless conveyor belt 8 which is looped around the rollers 6 and 7; a nip roller 4 and a peel plate 5 which are disposed outside the loop of the conveyor belt 8, a platen 9 which is disposed inside the loop of the conveyor belt 8; and the like.

The belt roller 7 is a drive roller and is driven by a conveyor motor 19 to rotate in a clockwise direction in FIG. 1. Along with the rotation of the belt roller 7, the conveyor belt 8 travels in a direction indicated by bold arrows in FIG. 1. The belt roller 6 is a driven roller, and rotates in the clockwise direction in FIG. 1 along with the travel of the conveyor belt 8. The nip roller 4 is disposed so as to be opposed to the belt roller 6. The nip roller 4 presses a sheet P fed from a later-described upstream guide unit onto an external surface 8*a* of the conveyor belt 8. The peel plate 5 is disposed so as to be opposed to the belt roller 7. The peel plate 5 peels the sheet P from the external surface 8*a* and guides the sheet P to a later-described downstream guide unit. The platen 9 is disposed so as to be opposed to the four heads 2. The platen 9 supports an upper portion of the loop of the conveyor belt 8 from the inside thereof. This creates a predetermined gap suitable for recording an image, between the external surface 8*a* and the ejection surfaces 2*a* of the heads 2.

The guide unit includes the upstream guide unit and the downstream guide unit which are disposed with the conveyor unit 21 interposed therebetween. The upstream guide unit includes: two guides 27*a* and 27*b*; and a pair of feed rollers 26, and the upstream guide unit connects a later-described paper feed unit 1*b* to the conveyor unit 21. The downstream guide unit includes: two guides 29*a* and 29*b*; and two pairs of feed rollers 28, and the downstream guide unit connects the conveyor unit 21 to the discharged paper receiver 31.

In the space B, the paper feed unit 1*b* is disposed. The paper feed unit 1*b* includes a paper feed tray 23 and a paper feed roller 25, and the paper feed tray 23 is removable from the housing 1*a*. The paper feed tray 23 is a box having an open top, and contains different sizes of sheets P. The paper feed roller 25 forwards an uppermost sheet P of the sheets P in the paper feed tray 23, and feeds the sheet P to the upstream guide unit.

As described above, the sheet conveyance path extending from the paper feed unit 1*b* to the discharged paper receiver 31 via the conveyor unit 21 is formed in the spaces A and B. When the controller 100 drives the paper feed roller 25, feed rollers 26 and 28, conveyor motor 19, and the like, based on a recording command, a sheet P is forwarded from the paper feed tray 23. The sheet P is fed to the conveyor unit 21 by the feed rollers 26. When the sheet P passes immediately below each head 2 in the sub scanning direction, ink is ejected from each ejection surface 2*a*, and a color image is recorded on the sheet P. The sheet P is then peeled by the peel plate 5, and is conveyed by the two pairs of feed rollers 28 upwardly. Then, the sheet P is discharged to the discharged paper receiver 31 via an opening 30 in an upper portion.

Note that the sub scanning direction is parallel to the direction in which a sheet P is conveyed by the conveyor unit 21. The main scanning direction is parallel to a horizontal surface and orthogonal to the sub scanning direction.

In the space C, an ink unit 1*c* is disposed removably from the housing 1*a*. The ink unit 1*c* includes: a cartridge tray 35; and four cartridges 40 arranged in the tray 35. Each cartridge 40 supplies ink to a corresponding head 2 via an ink tube.

Next, with reference to FIGS. 2 to 5, more detailed description will be given on the structure of each head 2. Note that, in FIG. 3, pressure chambers 16 and apertures 15, which are located below the actuator units 120 and should be depicted with dotted lines, are depicted with solid lines.

Figure 2:
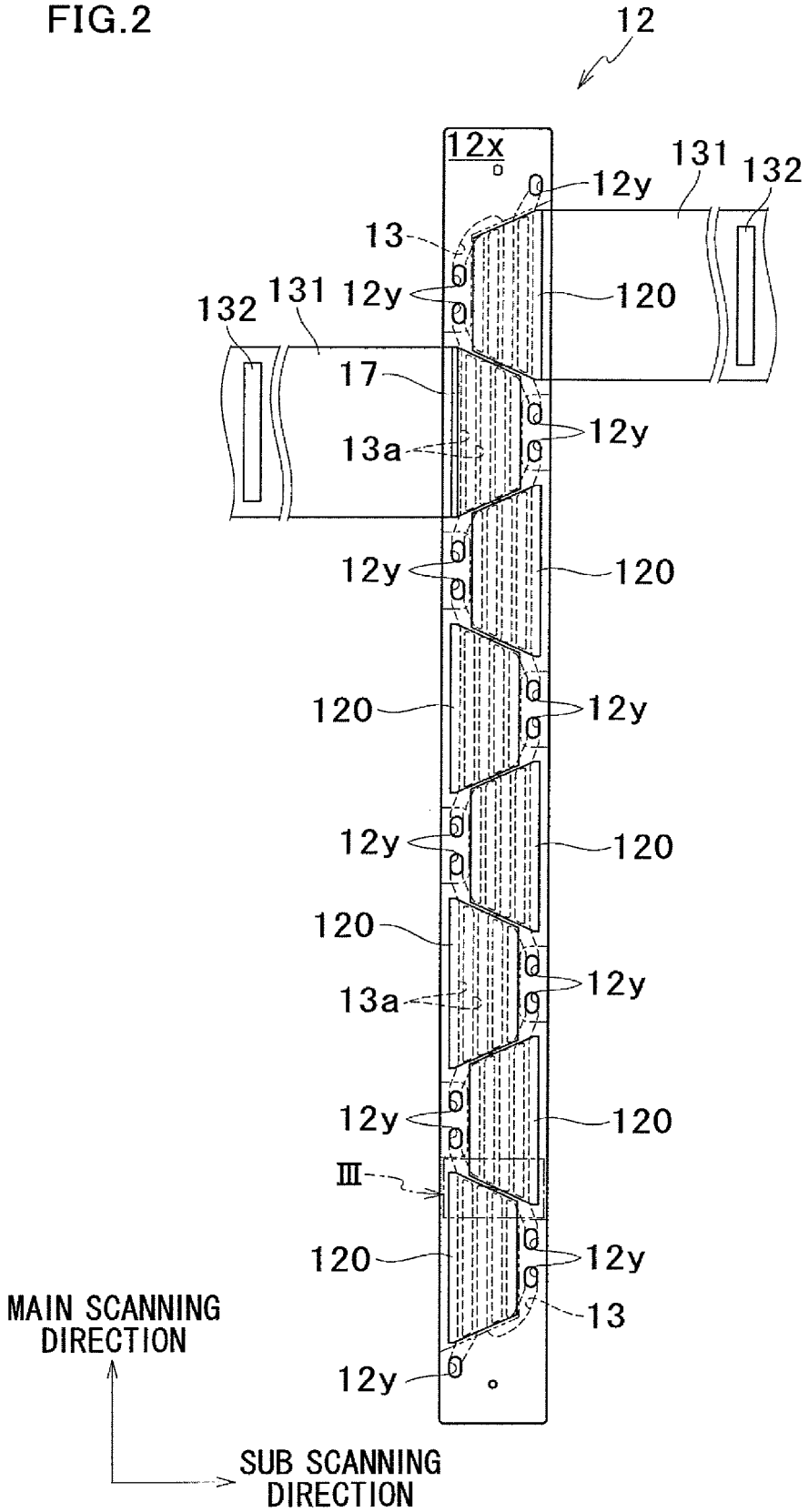
FIG. 2 is a plan view of a passage unit which constitutes a lower structure of each ink-jet head of FIG. 1.

The head 2 includes: an upper structure functioning as an ink reservoir; and a lower structure to which ink is supplied from the upper structure. In the upper structure, ink supplied from the corresponding cartridge 40 is stored. As shown in FIG. 2, the lower structure includes the passage unit 12 and the actuator units 120.

Figure 3:
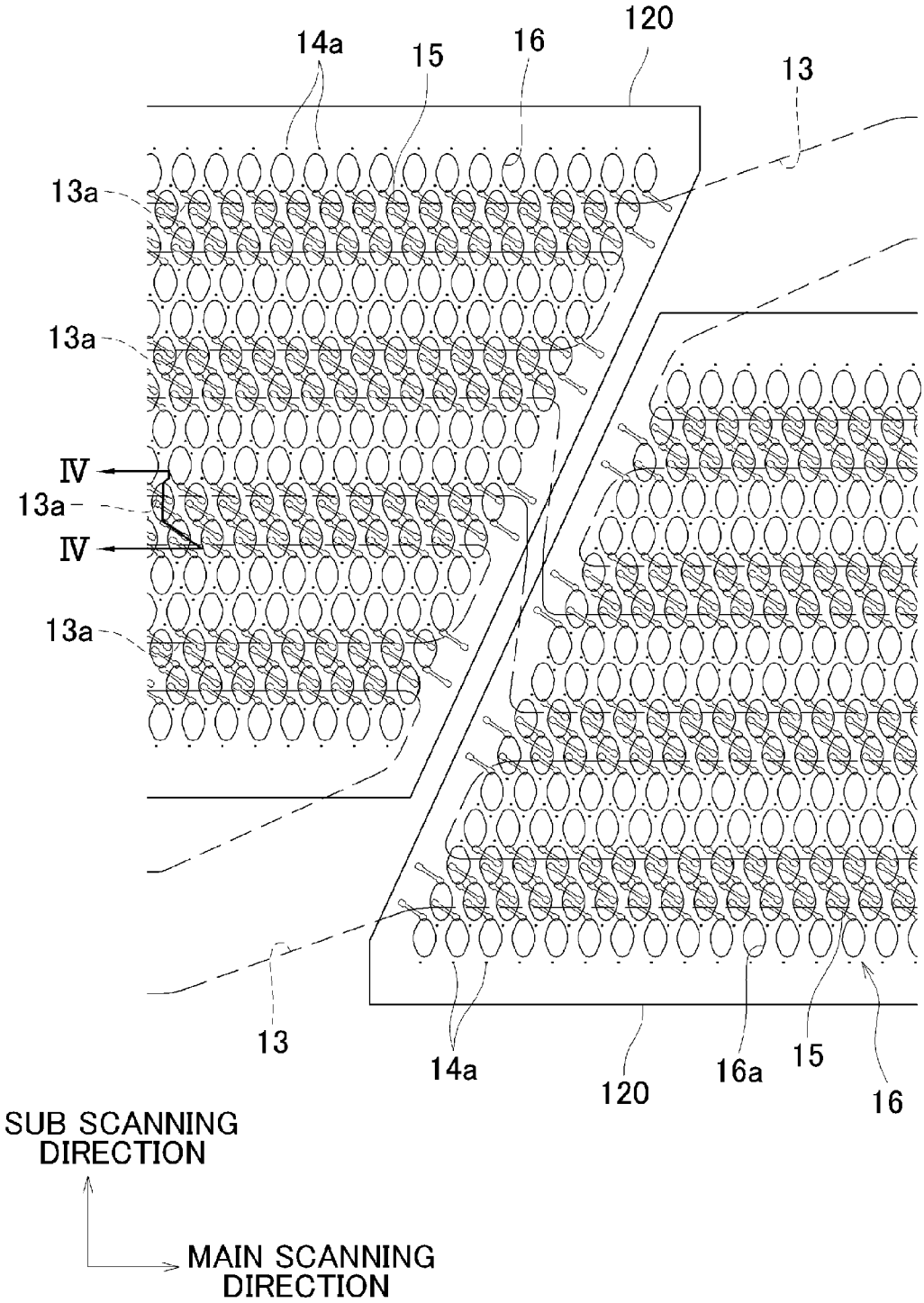
FIG. 3 is an enlarged view of a region indicated by an alternate long and two short dashes line III of FIG. 2.
Figure 4:
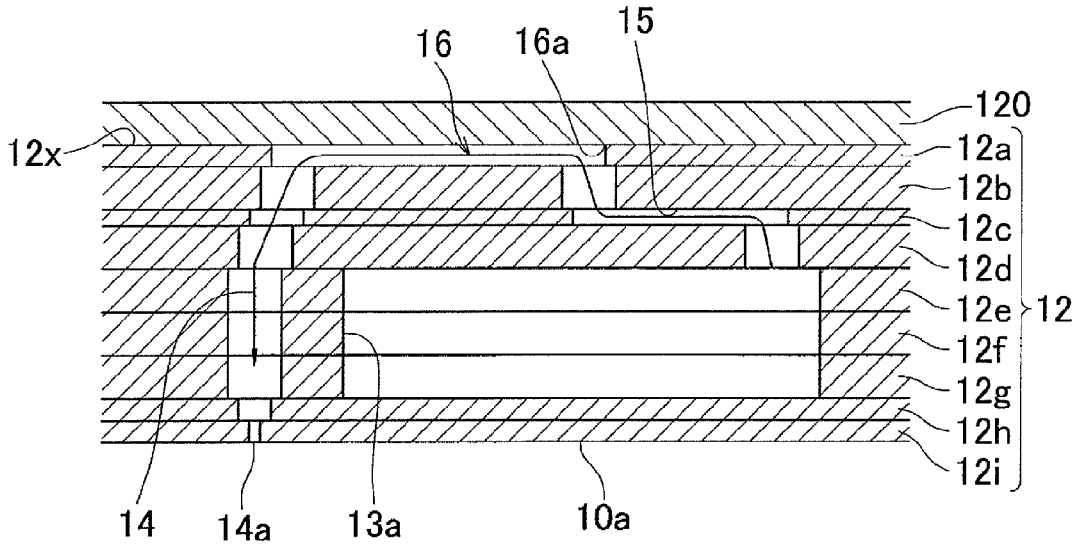
FIG. 4 is a sectional view of the passage unit, taken along a line IV-IV of FIG. 3.

As shown in FIG. 4, the passage unit 12 is a stack constituted of nine metal plates 12*a*, 12*b*, 12*c*, 12*d*, 12*e*, 12*f*, 12*g*, 12*h*, and 12*i* attached to one another. These plates have a quadrangular shape of the substantially same size. As shown in FIG. 2, openings 12*y* are formed in a top surface 12*x* of the passage unit 12. Ink from the upper structure flows into the passage unit 12 through the openings 12*y*. Inside the passage unit 12, there are formed ink passages extending from the openings 12*y* to ejection openings 14*a*. As shown in FIGS. 2 to 4, each ink passage includes: a manifold channel 13 having the opening 12*y* at its one end; sub-manifold channels 13*a* which are branches of the manifold channel 13; and individual ink passages 14 respectively extending from outlets of the sub-manifold channels 13*a* to the ejection openings 14*a* via the pressure chambers 16.

The individual ink passages 14 are formed for the respective ejection openings 14*a*. As shown in FIG. 4, each individual ink passage 14 includes a throttle for adjusting passage resistance. Each pressure chamber 16 opens onto the top surface 12*x*. The pressure chambers 16 constitute pressure chamber groups each occupying a trapezoidal area in a plan view. Each ejection opening 14*a* opens onto the under surface (the ejection surface 2*a*). A group of ejection openings 14*a* occupy a trapezoidal area in a plan view. There are eight pairs of trapezoidal areas. The trapezoidal areas of the pressure chambers 16 are respectively opposed to the trapezoidal areas of the ejection openings 14*a* in a thickness direction of the passage unit.

As shown in FIG. 2, each actuator unit 120 has a trapezoidal planar shape. The actuator units 120 are arranged on the top surface 12*x* in a staggered fashion in two rows. As shown in FIG. 3, the actuator units 120 are respectively disposed on the trapezoidal areas occupied by the respective pressure chamber groups.

To each actuator unit 120, a drive signal is supplied from a corresponding driver IC 132. The driver IC 132 supplies the drive signal based on a control command from the controller 100. Each actuator unit 120 is connected to the controller 100 through an FPC 131. The FPC 131 is a flat flexible substrate. The driver IC 132 is mounted on the FPC 131. The FPC 131 is provided for each actuator unit 120.

Next, more detailed description will be given on the structure of each actuator unit 120, with reference to FIG. 5.

Figure 5A:
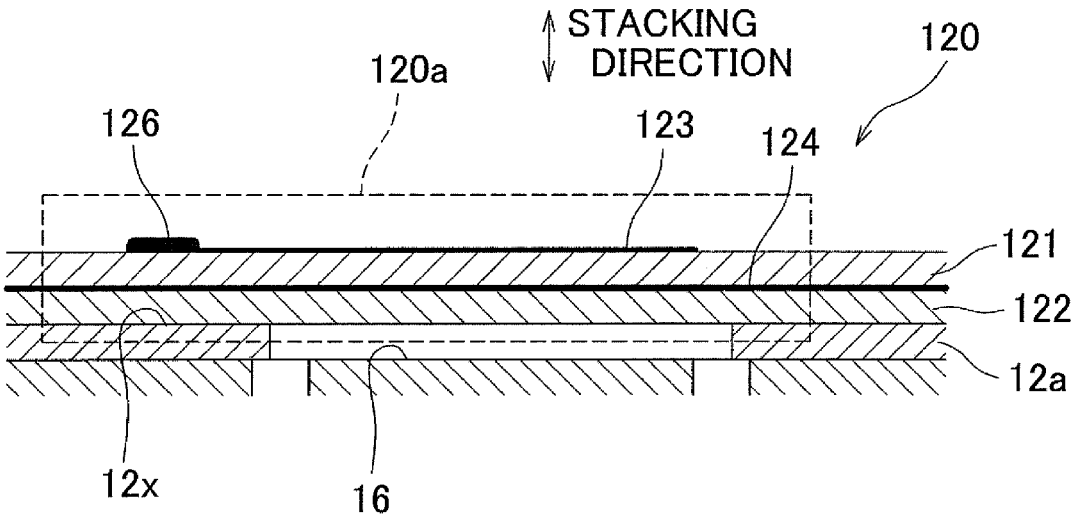
FIG. 5A is an enlarged view of an actuator unit of FIG. 4 with its vicinities.

As shown in FIG. 5A, each actuator unit 120 is a stack structure stacked on the top surface 12*x* of the passage unit 12. The stack structure is constituted of, in the following order from the top: an individual electrode 123, a piezoelectric layer 121, a common electrode 124, and a piezoelectric layer 122 which are stacked on one another. Note that the individual electrode 123 and the common electrode 124 correspond to first and second electrodes in the present invention, in no particular order. One actuator unit 120 is disposed so as to entirely cover the corresponding one pressure chamber group.

The piezoelectric layers 121 and 122 are sheet members made of lead zirconate titanate (PZT)-base ceramic having ferroelectricity. The piezoelectric layers 121 and 122 have the same size and shape as each other in a plan view. Of these, the piezoelectric layer 121 is polarized in a stacking direction of the stack structure. A thickness of each of the piezoelectric layers 121 and 122 is 15 μm.

Figure 5B:
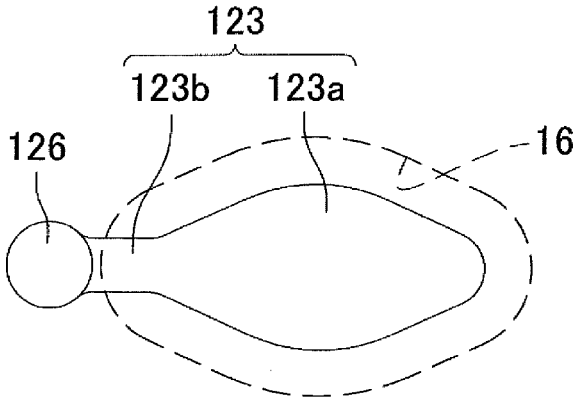
FIG. 5B is a plan view illustrating an individual electrode and a land.

Both of the individual electrode 123 and the common electrode 124 are made of Au (gold), and have a thickness of approximately 1 μm. The individual electrode 123 is disposed so as to be opposed to the corresponding pressure chamber 16. As shown in FIG. 5B, each individual electrode 123 is constituted of a main portion 123*a* and an extension 123*b*. The main portion 123*a* has a rhombus shape analogous to that of the pressure chamber 16 in a plan view, but is somewhat smaller than the pressure chamber 16. The extension 123*b* is extended from one of acute angles of the main portion 123*a* and a leading end of the extension 123*b* is connected to a land 126 outside a region corresponding to the pressure chamber 16. The common electrode 124 is formed across an upper surface of the piezoelectric layer 122. The common electrode 124 is grounded and is kept at ground potential.

The land 126 is made of Ag—Pd (silver-palladium) alloy. The land 126 has a shape of a column of 10 μm in height, and 130 μm in diameter. Each land 126 is connected to an output terminal of the corresponding driver IC 132 via the FPC 131. To the land 126, a drive signal is supplied via the FPC 131 when selected.

When a drive signal is supplied from the driver IC 132, the actuator unit 120 applies a pressure to ink in the corresponding pressure chamber 16, as follows. The drive signal is supplied to the corresponding individual electrode 123 via the land 126. At this time, an electric field in a polarization direction is generated at a portion of the piezoelectric layer 121 which is sandwiched between the two electrodes 123 and 124. This causes the piezoelectric layer 121 to contract in a direction orthogonal to the polarization direction, i.e., in a direction of its plane. On the other hand, the piezoelectric layer 122 is not deformed in such a way. This brings about a difference in strain between the piezoelectric layers 121 and 122. The difference in strain causes a portion sandwiched between the individual electrode 123 and the pressure chamber 16 to protrude toward the pressure chamber 16. It is possible to cause such unimorph deformation for each individual electrode 123. The unimorph deformation causes ink in the pressure chamber 16 to be pressurized. When this provides the ink with sufficient energy for ejection, ink droplets are ejected from the ejection opening 14*a*. Thus, in the actuator unit 120, an actuator 120*a* is constructed for each pressure chamber 16.

Next, specific description will be given for the drive signal, with reference to FIGS. 6, and 7A to 7C. As shown in FIG. 6, the controller 100 includes: a drive signal generating unit 111; a supply control unit 114; a waveform storing unit 112; and a reference voltage storing unit 113. These function units cooperate with one another to generate the drive signal, and supplies the generated drive signal to the corresponding actuator 120*a*. A drive signal includes one or more rectangular pulses in a unit time. Each rectangular pulse generally has a height corresponding to a reference voltage V0. Depending on an ambient temperature, there is a case where the height of the rectangular pulse does not correspond to V0, as will be described later. In response to each rectangular pulse, the actuator 120*a* pressurizes ink in the pressure chamber 16. Note that, the unit time means one printing time period which is equivalent to a period of time required for a sheet P to be conveyed a unit distance in accordance with the resolution of an image to be formed.

The waveform storing unit 112 stores information on a waveform of a drive signal. This information includes information indicating a pulse height and a pulse width of each rectangular pulse included in the drive signal. Further, this is the information on a waveform such that, when each rectangular pulses is supplied to the individual electrode 123, the potential of the individual electrode 123 is changed from a positive potential to ground potential and then is returned to the positive potential after a predetermined time has passed. There are plural types of waveforms corresponding to amounts of ink droplets to be ejected during one printing time period. The reference voltage storing unit 113 stores a reference voltage, such as the reference voltage V0 which is a normal voltage of the drive signal.

Figure 7A:
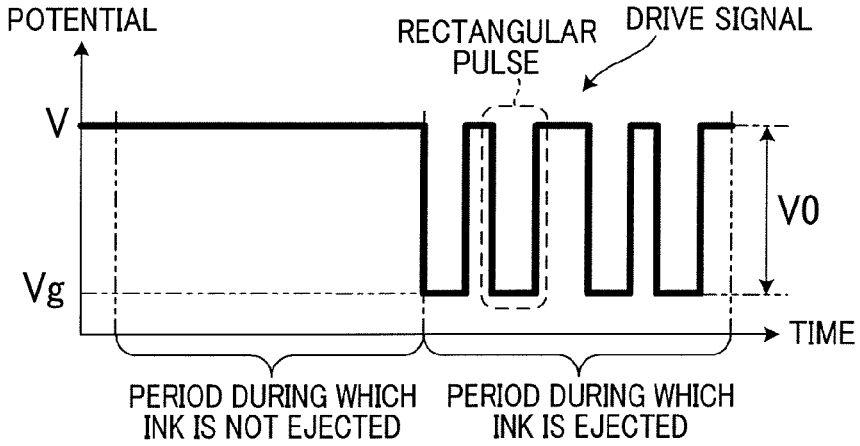
FIGS. 7A to 7C are graphs each showing a potential of a drive signal supplied to the individual electrode.

The drive signal generating unit 111 generates a drive signal on a per-printing time period basis, based on image data. At this time, the type of waveform to be outputted from the waveform storing unit 112 is selected, and the reference voltage V0 stored in the reference voltage storing unit 113 is set as the normal voltage. FIG. 7A shows one example of a drive signal. In FIG. 7A, a potential Vg is ground potential. Meanwhile, a potential V (>0) is a potential whose difference from the potential Vg corresponds to the reference voltage V0. As shown in FIG. 7A, the potential of the drive signal is kept at V during (i) a standby period, during which ink is not ejected, and (ii) periods between the rectangular pulses.

The supply control unit 114 generates a supply instruction signal on a per-printing time period basis, based on the image data. The supply instruction signal instructs: an actuator 120*a* to which the drive signal is to be supplied; and a timing at which the signal is supplied. The supply instruction signal is supplied to the corresponding driver IC 132 in each printing time period. The driver IC 132 supplies the drive signal to the actuator 120*a* designated by the supply instruction signal. With this, the actuator 120*a* is selectively driven.

The actuator 120*a* operates as follows when the drive signal is supplied.

During the standby period, the individual electrode 123 is kept at the potential V. A difference between the ground potential Vg, which is the potential of the common electrode 124, and the potential V corresponds to the reference voltage V0. This causes unimorph deformation of the actuator 120*a*. At this time, the capacity of the pressure chamber 16 is U1. When a first rectangular pulse of the drive signal is applied to the individual electrode 123, the potential V of the individual electrode 123 is changed to the ground potential Vg. This causes the potential difference between the common electrode 124 kept at the ground potential Vg and the individual electrode 123 to be zero, and therefore the unimorph deformation disappears. As a result, the capacity of the pressure chamber 16 is increased from U1 to U2, and ink is supplied from the sub-manifold channel 13*a* to the pressure chamber 16. Then, when the potential of the individual electrode 123 is returned from Vg to V, the unimorph deformation is caused in the actuator 120*a* and the capacity of the pressure chamber is returned to U1. With this decrease in capacity, a positive pressure is applied to the ink in the pressure chamber 16. Thereby, the ink is ejected from the ejection opening 14*a*.

Figure 7B:
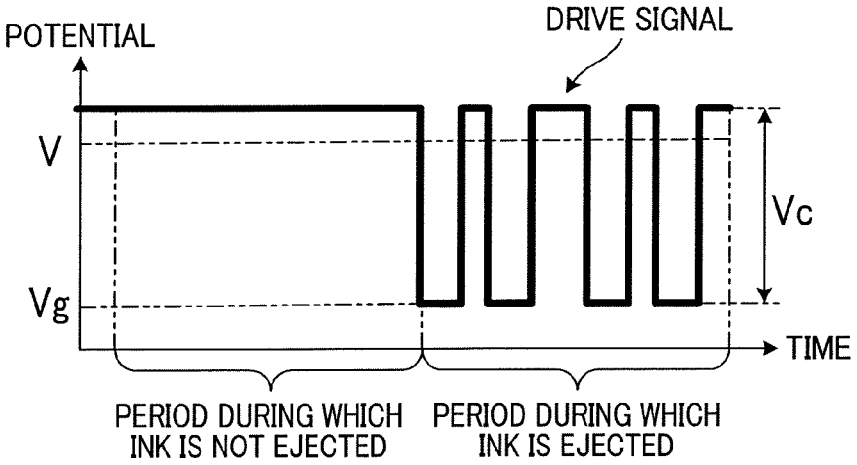
Figure 7C:
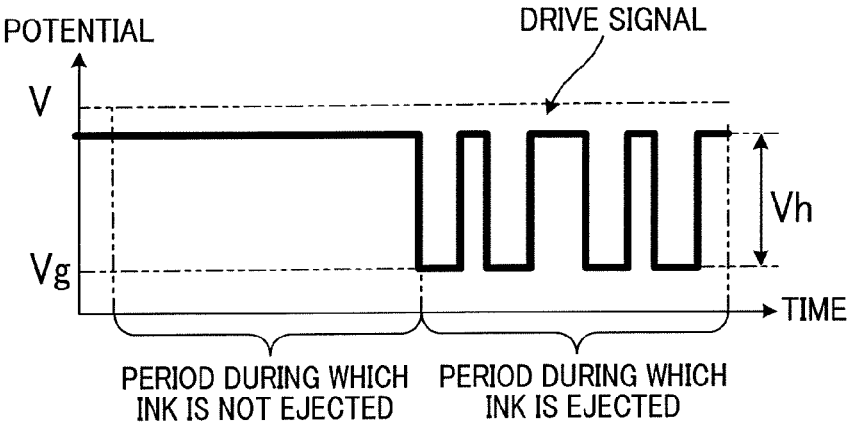

Here, an amount of ink ejected from the ejection opening 14*a* by one rectangular pulse depends on the ambient temperature. For example, the lower the temperature is, the higher the viscosity of ink is, and therefore the amount of ejected ink is decreased. The reference voltage V0 is set so that a desired amount of ink is ejected under a standard temperature condition. When the ambient temperature is out of the range of the standard temperature condition, the amount of ejected ink is also changed. Therefore, in order that a constant amount of ink is always ejected, the drive signal generating unit 111 revises the reference voltage, based on the ambient temperature. The ambient temperature is detected by the temperature sensor 140. When the ambient temperature is lower than those of the standard condition, the revision is made so that the height of each rectangular pulse corresponds to a voltage greater than the reference voltage V0. FIG. 7B shows one example of a drive signal on which such revision has been made. On the other hand, when the ambient temperature is higher than those of the standard condition, the revision is made so that the height of each rectangular pulse corresponds to a voltage lower than the reference voltage V0. FIG. 7C shows one example of a drive signal on which such revision has been made. The above-described structure allows the amount of ejected ink droplets to be kept substantially constant irrespective of the ambient temperature. Note that, in this embodiment, the reference voltage stored in the reference voltage storing unit 113 is commonly used in all the heads 2.

Table 1 presented below shows, as one example, temperatures and revised voltages, which are used as a basis when the reference voltage is revised. Based on Table 1, the drive signal generating unit 111 revises the reference voltage. Temperatures in a range from T1 to T2 correspond to those of the standard temperature condition. When the temperature falls within this range, no revision is made and the reference voltage V0 is used. When the temperature is less than T1, the reference voltage is revised from V0 to Vc=V0*1.4. This allows the height of each rectangular pulse to be higher than that in a case where the ambient temperature falls within the range of the standard temperature condition. Therefore, the degree of deformation of the actuator 120*a* is increased, and as a result, the desired ejection amount is obtained. On the other hand, when the temperature is more than T2, the reference voltage is revised from V0 to Vh=V0*0.8. This allows the height of the rectangular pulse to be lower than that in the case where the ambient temperature falls within the range of the standard temperature condition. Therefore, the degree of deformation of the actuator 120*a* is decreased, and as a result, the desired ejection amount is obtained.

TABLE 1

| | Temperature | | |
|---|---|---|---|
| | Less than T1 | Standard Temperature Condition T1 to T2 | More than T2 |
| Revised voltage | Vc = V0 * 1.4 | V0 (not revised) | Vh = V0 * 0.8 |

Meanwhile, there has been known that a long-time drive of a piezoelectric actuator like the actuator 120*a* may cause deterioration of deformation properties of the piezoelectric layer and thereby the amount of ejected ink is decreased. In order to decrease an influence of the deterioration of deformation properties, there has been conventionally employed a technique to ensure a necessary ejection amount by increasing a voltage of a drive signal when the number of ejections of ink reaches a predetermined number.

Figure 8A:
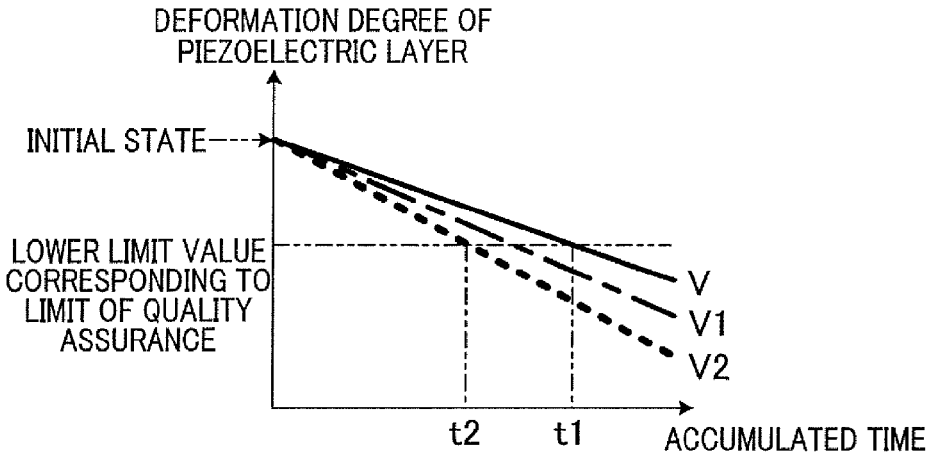
FIG. 8A is a graph schematically showing a relation between an accumulated time during which an electric field is applied to a piezoelectric layer and the degree of deformation of the piezoelectric layer.

However, according to the knowledge of the present inventor, the deterioration of the piezoelectric layer depends on: (1) an accumulated time during which an electric field is applied to the piezoelectric layer as a result that a voltage is applied between the electrodes; and (2) an intensity of the applied electric field. For example, FIG. 8A shows, for respective cases where the voltages applied to the piezoelectric layer are V0, V1, and V2, variations in the degree of deformation ("deformation degree") of the piezoelectric layer 121 with respect to the accumulated time during which the respective voltages are applied. Among the applied voltages, there is a relation that V0<V1<V2. As shown in FIG. 8A, the deformation degree of the piezoelectric layer 121 is decreased over time in every case. Further, the higher the voltage applied to the piezoelectric layer 121 is, in other words, the greater the electric field applied to the piezoelectric layer 121 is, the larger the rate of decrease in the deformation degree is.

Here, the increase/decrease in the deformation degree causes a change in the amount of ejected ink, and affects the quality of an image. The higher an applied voltage is, the higher the speed of decrease in the deformation degree is, and so the sooner a limit of quality assurance is reached, which is a limit of a range within which the quality of the image is assured. Accordingly, in a case where a voltage to be applied is revised to be a higher voltage corresponding to the deterioration of the piezoelectric layer, the deterioration of the piezoelectric layer is accelerated every time the revision is made, so that the limit of quality assurance is reached soon. In this case, there is a possibility that the revision of the voltage to be applied cannot suitably deal with the deterioration of the quality of an image. Further, since the voltage to be applied is revised based on the ambient temperature in this embodiment, the limit of quality assurance is reached further sooner in the case where a low-temperature environment continues. Note that, the limit of quality assurance is a limit of a range within which a user is unable to recognize a change in quality.

In this embodiment, an upper limit value of the deformation degree of the piezoelectric layer 121, which value corresponds to the limit of quality assurance, is larger than an initial value of the deformation degree at a time of manufacturing the apparatus; while a lower limit value of the deformation degree, which value corresponds to the limit of quality assurance, is smaller than the initial value.

Then, this embodiment employs a following structure to change the reference voltage, which is different from the conventional art. As shown in FIG. 6, the controller 100 includes: a voltage value changing unit 151; an accumulated time calculating unit 152; a change interval setting unit 153; and a statistical temperature calculating unit 154.

The accumulated time calculating unit 152 calculates an accumulated time during which a voltage is applied to the piezoelectric layer 121. When the actuator 120*a* is driven, the printing time period is predetermined. A time required for the individual electrode 123 to be shifted to the ground potential in response to a rectangular pulse supplied is also predetermined How many rectangular pulses are supplied and how the rectangular pulses are supplied are instructed by the image data in each printing time period. Therefore, based on the image data, it is possible to obtain the accumulated time in the period of printing operation, for each actuator 120*a*. By adding a period of time of a standby state or the like to the above time, the accumulated time for each actuator 120*a* is calculated accurately.

However, the above calculation method needs a high processing load since the drive status of each actuator 120*a* is monitored. When it is necessary to decrease the processing load, the actuators 120*a* which are subjected to the calculation may be limited to a part of the actuators 120*a*. The number of actuators 120*a* subjected to the calculation may be any number of one or more. For example, in each actuator unit 120, one actuator 120*a* is selected to be subjected to the calculation. Note that, depending on the size of a sheet P, there may be an actuator unit 120 which is not driven. In such a case, one actuator 120*a* is selected to be subjected to the calculation in each of the actuator units 120 which are to be driven, irrespective of the size of the sheet P.

Figure 8B:
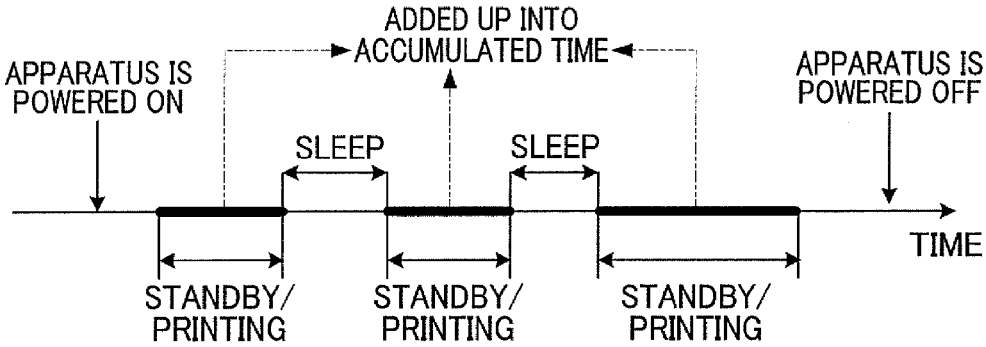
FIG. 8B is a timing chart showing a state of the printer from the point of powering on to the point of powering off of the printer.

Still another calculation method may be employed, as follows. This is the method employed in this embodiment, in which method a particular actuator is not selected as an object of the calculation. In this method, a period of time in which the individual electrode 123 is at the ground potential in a drive signal is disregarded. Then, each approximate period of time in which the individual electrode 123 is at potentials other than the ground potential is obtained, and the thus obtained periods of time are added up to calculate the accumulated time. The potentials other than the ground potential include: a potential of which potential difference between the individual electrode 123 and the common electrode 124 is not zero, that is, of which potential difference is the reference voltage V0, or the revised voltage Vc or Vh. For example, as shown in FIG. 8B, let us assume that, during a period where the apparatus is powered on, the reference voltage V0, Vc, or Vh is supplied to the individual electrode 123 when the apparatus is in a standby status or carries out printing; while the individual electrode 123 is always kept at the ground potential when the apparatus is in a sleep status. In this case, the accumulated time calculating unit 152 adds up periods of time where the apparatus is in the standby status or carries out printing, thereby obtaining the accumulated time. Note that, the period in which the apparatus is in the sleep status includes, for example: a period of time from the end of printing on one sheet P to the start of printing on a next sheet P; a period of time in which the apparatus is in a non-operating status into which the apparatus is shifted after the standby status continues for a predetermined time; or the like. In the non-operating status, the individual electrode 123 is at the ground potential until it receives a printing command.

The statistical temperature calculating unit 154 calculates a statistical temperature based on temperatures detected by the temperature sensor 140. In this embodiment, the statistical temperature is a value obtained by time-averaging the temperatures detected during a period from the last time the reference voltage is changed to the present moment. The thus obtained statistical temperature is reset every time the reference voltage is changed.

The change interval setting unit 153 determines an interval between times at which the reference voltage is changed. The change interval setting unit 153 has information such as a relational expression or a table corresponding to FIG. 8A, in association with various voltage values. For example, when the ambient temperature in the apparatus is always within the range from T1 to T2, the reference voltage V0 is used for a drive signal without change. Let us assume that: the deformation degree of the piezoelectric layer 121 is the initial value at the beginning; and the reference voltage V0 continues to be used as the voltage supplied to the individual electrode 123. In this case, according to FIG. 8A, the deformation degree of the piezoelectric layer 121 reaches the value corresponding to the limit of quality assurance at an accumulated time t1. Therefore, the change interval setting unit 153 sets a next timing for changing the reference voltage, at the time at which the accumulated time reaches t1. Thus, a time interval to the next change is determined.

On the other hand, when the ambient temperature in the apparatus is out of the range from T1 to T2, the reference voltage is revised depending on the ambient temperature, in this embodiment. In that case, the change interval setting unit 153 derives a revised voltage from Table 1, based on the statistical temperature. For example, when the temperature is less than T1 in a very low-temperature environment, the revised voltage is set so that Vc=V2. At this time, t2 (<t1) is derived from FIG. 8A as a time at which the deformation degree of the piezoelectric layer 121, which was in the initial state, reaches the value corresponding to the limit of quality assurance. Therefore, the change interval setting unit 153 sets the next timing for changing the reference voltage, at the time at which the accumulated time reaches t2. Thus, a time interval to the next change is determined depending on the ambient temperature.

Since the reference voltage after the change has a larger voltage value than that before the change, the change interval setting unit 153 necessarily determines a new time interval so that it is shorter than the time interval just before the new time interval. The above process is carried out regardless of whether or not revision has been made on the reference voltage in accordance with the temperature.

The voltage value changing unit 151 changes the reference voltage to a higher voltage when the accumulated time calculated by the accumulated time calculating unit 152 reaches the time interval determined by the change interval setting unit 153. The voltage is changed so that the following conditions are satisfied (see FIG. 10A). (Condition 1) The deformation degree of the piezoelectric layer 121 immediately after a change of the voltage is larger than the initial value, and is a predetermined upper limit value corresponding to the limit of quality assurance (hereinafter simply referred to as "upper limit value"). (Condition 2) A difference between the deformation degree of the piezoelectric layer 121 immediately before a change of the voltage and the deformation degree of the piezoelectric layer 121 immediately after the change is constant in each change. (Condition 3) An amount of change in the voltage (i.e., an increment of the voltage value) is constant in each change of the voltage. Note that, since the voltage is changed based on the approximate accumulated time and the statistical temperature in this embodiment, the conditions 1 to 3 are not strictly satisfied, but are substantially satisfied.

The following details the conditions 1 to 3. A characteristic of the condition 1 is that the deformation degree of the piezoelectric layer 121 is not returned to the initial value, but is set to a value larger than the initial value. This increases a period from the time of change the voltage to the time at which the quality of an image reaches the limit of quality assurance due to a decrease in the deformation degree. Further, in the condition 1, the deformation degree immediately after the change is set to the upper limit value corresponding to the limit of quality assurance. This increases the time interval to the next voltage change at a maximum. Therefore the quality of an image is maintained with the smaller number of voltage changes. Note that, in this embodiment, the initial value of the deformation degree of the piezoelectric layer 121 is set so as to be exactly intermediate between the upper limit value corresponding to the limit of quality assurance and a lower limit value corresponding to the limit of quality assurance (hereinafter, simply referred to as "lower limit value").

The condition 2 is naturally derived from: the above-described method of determining the timing for changing the voltage; and the condition 1. The quality of an image is determined with reference to the quality of its initial state. Every time the voltage is changed, the deformation degree of the piezoelectric layer 121 is changed from the lower limit value to the upper limit value. That is, the difference in the deformation degree between before and after a voltage change is constant in each voltage change.

The condition 3 is consistent with the conditions 1 and 2 when the following ideal condition is satisfied: a constant amount of change in the reference voltage allows the deformation degree of the piezoelectric layer to be changed from the lower limit value to the upper limit value. Generally, the deformation degree linearly changes with respect to the intensity of electric field in a wide range. However, there is a case that the deformation degree does not linearly changes with respect to the intensity of electric field. This is, for example, a case where the condition 2 is not able to be satisfied unless the difference in the reference voltage between before and after a voltage change is increased every time the voltage is changed. In such a case, it is preferable to adjust the amount of change in the reference voltage so that the conditions 1 and 2 are satisfied preferentially.

Figure 9:
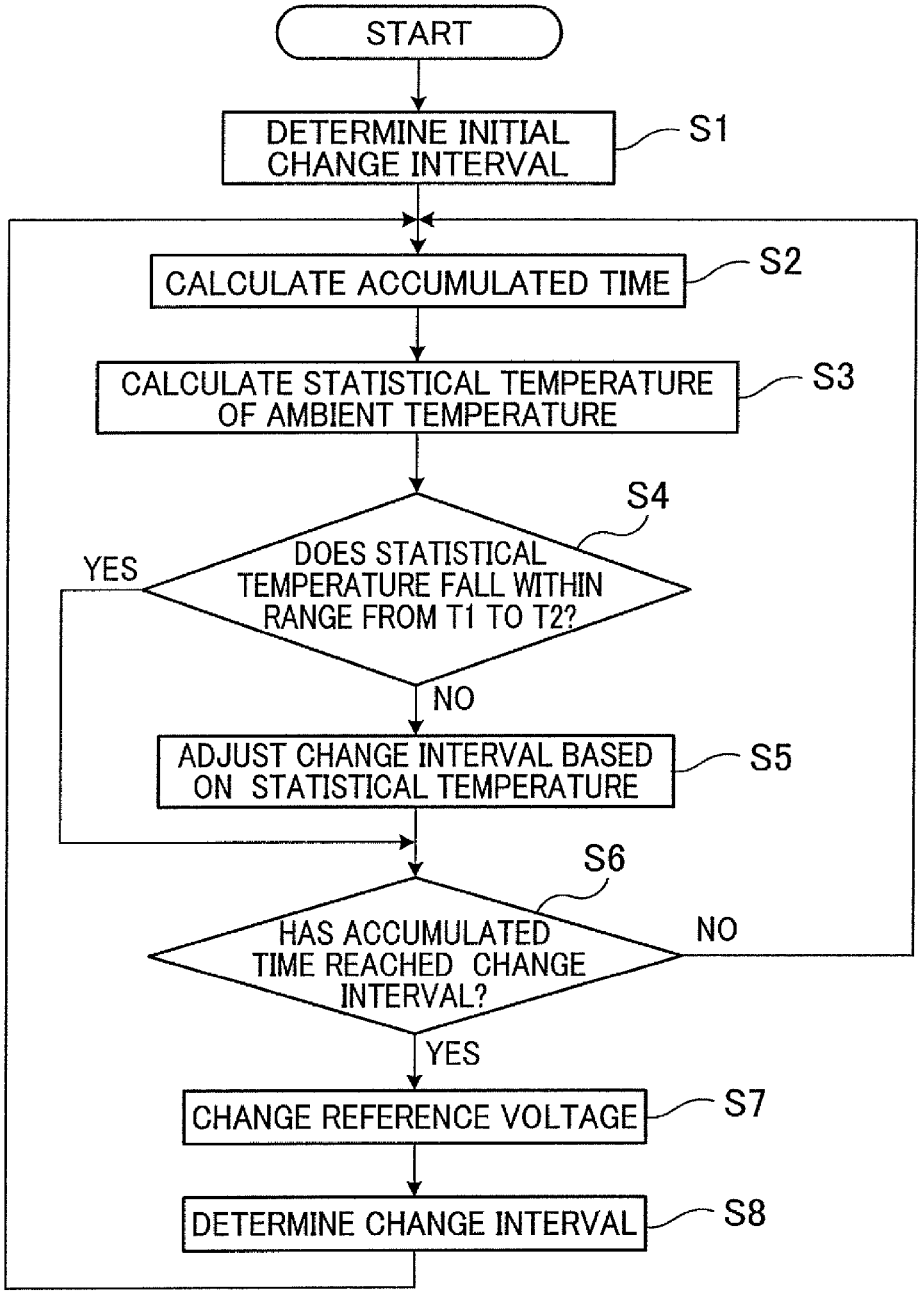
FIG. 9 is a flowchart showing sequential steps of a process of changing a reference voltage.

The following describes one example of processing steps of changing the reference voltage, with reference to FIG. 9. First, the change interval setting unit 153 determines a change interval $\Delta t_1$, which is a time interval to a first change of the reference voltage (step S1). Hereinafter, a time interval between an n−1th change of the reference voltage and nth (n: natural number not less than 2) is expressed as change interval $\Delta t_n$. Next, the accumulated time calculating unit 152 calculates an accumulated time during which an electric field is applied to the piezoelectric layer 121 (step S2). Further, the statistical temperature calculating unit 154 calculates a statistical temperature based on temperatures detected by the temperature sensor 140 (step S3).

Next, the change interval setting unit 153 determines whether or not the calculated statistical temperature falls within the range from T1 to T2 (see Table 1) (step S4). Then, when it is determined that the statistical temperature falls within the range from T1 to T2 (step S4, Yes), the process goes to processing of step S6. On the other hand, when it is determined that the statistical temperature does not fall within the range from T1 to T2 (step S4, No), the change interval setting unit 153 adjusts the change interval based on the statistical temperature calculated by the statistical temperature calculating unit 154 (step S5). For example, assuming that the next change is a kth (k: natural number) change, the change interval setting unit 153 adjusts the change interval based on the statistical temperature, and determines the change interval as $\Delta t'_k$, instead of $\Delta t_k$.

Next, the voltage value changing unit 151 determines whether or not the accumulated time calculated by the accumulated time calculating unit 152 has reached the change interval $\Delta t_k$ determined by the change interval setting unit 153 ($\Delta t'_k$ in the case where the change interval is adjusted) (step S6). When it is determined that the accumulated time has reached the change interval $\Delta t_k$ ($\Delta t'_k$ in the case where the change interval is adjusted) (step S6, Yes), the voltage value changing unit 151 changes the reference voltage stored in the reference voltage storing unit 113 (step S7). At the time of changing the voltage, revision based on the statistical temperature is also made. Next, the change interval setting unit 153 determines a change interval $\Delta t_{k+1}$ to the next change (k+1th change), based on the new reference voltage (step S8). Then the process returns to the processing of step S2. On the other hand, when it is determined that, in step S6, the accumulated time has not reached the change interval $\Delta t_k$ ($\Delta t'_k$ in the case where the change interval is adjusted) (step S6, No), the process returns to the processing of step S2.

Figure 10A:
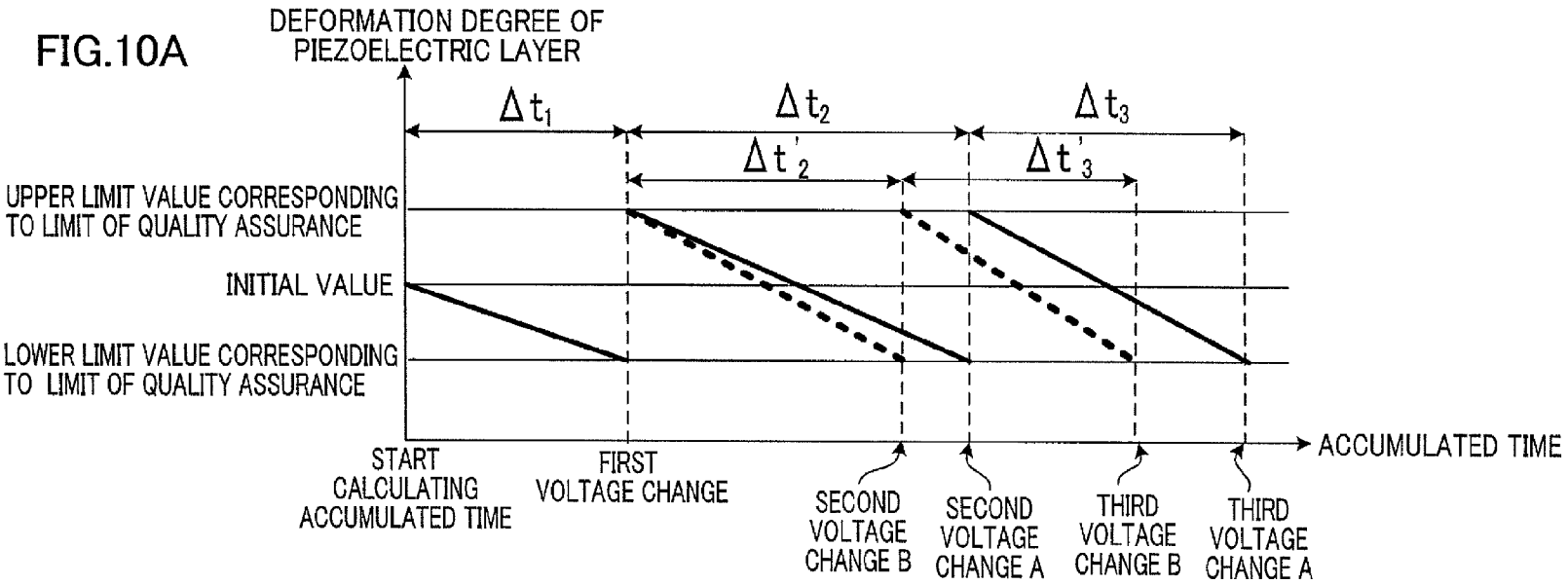
FIG. 10A is a graph showing how the degree of deformation of the piezoelectric layer varies when the process shown in FIG. 9 is carried out.

The following describes a relation between: the change of the reference voltage in accordance with the process shown in FIG. 9; and the deformation degree of the piezoelectric layer 121, with reference to FIG. 10A. Note that FIG. 10A shows an ideal relation between the accumulated time and the deformation degree of the piezoelectric layer 121, and the following description will be given in accordance therewith. However, the approximate accumulated time is used as the accumulated time in this embodiment, and therefore practically there is some discrepancy from a graph shown in FIG. 10A.

First of all, description will be given for a case where the statistical temperature calculated in step S3 always falls within the range from T1 to T2. First, the change interval $\Delta t_1$ is determined in step S1. The determined change interval $\Delta t_1$ is a time period over which the quality of an image varies from its initial state to the state of the limit of quality assurance. Calculation of the accumulated time is started, and as the accumulated time is increased, the deformation degree of the piezoelectric layer 121 is decreased as indicated by a solid line of FIG. 10A.

When the accumulated time has reached $\Delta t_1$, the deformation degree of the piezoelectric layer 121 reaches the above-described lower limit value. Then, a first change of the reference voltage is made in step S7. With this, the reference voltage is changed to have a value which causes the deformation degree of the piezoelectric layer 121 to be the above-described upper limit value. At this time, depending on the ambient temperature, revision based on the statistical temperature is made. However, no revision is made here since assumed is the case where the statistical temperature always falls within the range from T1 to T2. Further, a change interval $\Delta t_2$ to the next change is determined in step S8. The change interval $\Delta t_2$ is determined, based on the new reference voltage, as a time period over which the deformation degree of the piezoelectric layer 121 varies from the upper limit value to the lower limit value.

After the first change of the voltage, the deformation degree of the piezoelectric layer 121 is decreased as indicated by a solid line of FIG. 10A. When the accumulated time after the first change has reached $\Delta t_2$, the deformation degree of the piezoelectric layer 121 reaches the lower limit value. Then, a second change of the reference voltage ("second voltage change A" in FIG. 10A) is made in step S7. With this, the reference voltage is changed to have a value which causes the deformation degree of the piezoelectric layer 121 to be the upper limit value. Further, a change interval $\Delta t_3$ to the next change is determined in step S8. The change interval $\Delta t_3$ is determined, based on the new reference voltage, as a time period over which the deformation degree of the piezoelectric layer 121 varies from the upper limit value to the lower limit value.

When an accumulated time after the second voltage change A has reached $\Delta t_3$, a third change of the reference voltage ("third voltage change A" in FIG. 10A) is made in step S7.

A relation in length among $\Delta t_1$, $\Delta t_2$, $\Delta t_3$ is as follows. First, both of $\Delta t_2$ and $\Delta t_3$ are the time period over which the deformation degree of the piezoelectric layer 121 varies from the upper limit value to the lower limit value. However, the reference voltage based on which $\Delta t_3$ is determined is larger than the reference voltage based on which $\Delta t_2$ is determined. The larger the reference voltage is, the higher the speed of the decrease in the deformation degree, and therefore, the change intervals are determined so that $\Delta t_2 > \Delta t_3$, as shown in FIG. 10A.

On the other hand, $\Delta t_1$ is the time period over which the quality of an image varies from its initial state to the state of the limit of quality assurance, so $\Delta t_1 < \Delta t_2$ as shown in FIG. 10A. In this embodiment, the deformation degree of the piezoelectric layer 121 in the initial state is set to a value intermediate between the upper limit value and the lower limit value. However, supposing that the deformation degree of the piezoelectric layer 121 in the initial state is set to the upper limit value, the time interval to the first voltage change is calculated by: $a*\Delta t_1$ (a: real number greater than 1). The reference voltage based on which $\Delta t_2$ is determined is larger than the reference voltage based on which $\Delta t_1$ is determined Accordingly, a relation that $a*\Delta t_1 > \Delta t_2$ is satisfied. Thus, as long as the statistical temperature calculated in step S3 falls within the range from T1 to T2, the reference voltage is changed while the change intervals are determined so that the relation that $a*\Delta t_1 > \Delta t_2 > \Delta t_3 > \Delta t_4 > \Delta t_5 \ldots$ is satisfied.

Next, description will be given for a case where the statistical temperature calculated in step S3 does not fall within the range from T1 to T2. Let us assume that, for example, a state where the statistical temperature is less than T1 continues after the first voltage change. In this case, the change interval setting unit 153 adjusts the change interval based on the revised voltage Vc, which is obtained by revising the reference voltage V0. Since the deformation degree of the piezoelectric layer 121 varies at the voltage Vc which is larger than V0, the deformation degree is decreased faster, as indicated by a broken line in FIG. 10A, compared to the case indicated by the solid line. Then, at the time of "second voltage change B" which is earlier than the "second voltage change A", the quality of an image reaches the limit of quality assurance. Therefore, in step S5, the change interval to the second voltage change is adjusted to be $\Delta t'_2$ which corresponds to the revised voltage Vc. Here, since V0<Vc, $\Delta t'_2 < \Delta t_2$. When the accumulated time has reached $\Delta t'_2$, the second change of the reference voltage is made in step S7.

Because the statistical temperature is still less than T1 after the second change, the deformation degree of the piezoelectric layer 121 is decreased faster than the case indicated by the solid line, as indicated by the broken line in FIG. 10A. Therefore, in step S5, the change interval to a third voltage change is adjusted to be $\Delta t'_3$ which is smaller than $\Delta t_3$. When the accumulated time has reached $\Delta t'_3$, the third change of the reference voltage is made in step S7 ("third voltage change B" in FIG. 10A).

In the above-described embodiment, along with an increase in the value of the reference voltage, the change interval is shortened. Therefore, the reference voltage is changed adequately to keep pace with the deterioration of the deformation properties of the piezoelectric layer 121. Further, when generating a drive signal, the change interval is adjusted corresponding to the revised voltage which has been revised in accordance with the statistical ambient temperature. Therefore, even in a low-temperature environment or high-temperature environment, the reference voltage is changed adequately to keep pace with the deterioration. Furthermore, in this embodiment, the amount of change (increment) of the voltage value in each change of the reference voltage is constant, as is described in the above condition 3, and therefore, a mechanism for changing the voltage is realized with a simple structure.

Now, when a state where the statistical temperature calculated in step S3 is more than T2 continues, the time intervals between the changes of the reference voltage are shortened every time the reference voltage is changed. However, assuming that conditions at the last time the voltage is changed are the same regarding the deformation degree of the piezoelectric layer 121 and the reference voltage, a longer time interval is determined as the interval to the next change in the case where the statistical temperature is more than T2, than in a case where the statistical temperature is not more than T2.

Thus, the preferable embodiment of the present invention has been described. It should however go without saying that the present invention is not limited to the embodiment described above, and may be altered in various ways.

For example, in the above embodiment, the statistical temperature calculating unit 154 takes a time average of the temperatures detected by the temperature sensor 140 during the period from the last time the voltage is changed to the present moment, thereby obtaining the statistical temperature. However, the statistical temperature may be calculated in other ways. For example, a median value between the highest value and the lowest value among the temperatures detected during the period of time from the above last time to the present moment may be calculated and used as the statistical temperature.

Further, in the above embodiment, a common reference voltage is used in all the heads 2. However, the reference voltage may be set for each head 2 individually, or may be set for each actuator unit 120 individually. In this case, the change intervals of the reference voltage are also determined for each head 2, or for each actuator unit 120, individually. In this instance, the accumulated time may be calculated for each head 2, or for each actuator unit 120, and based on the obtained result, the reference voltage may be changed in each head 2, or in each actuator unit 120.

Furthermore, as shown in FIG. 10A, in the above embodiment, the conditions in changing the voltage are set so that: the deformation degree of the piezoelectric layer 121 immediately before changing the reference voltage is the lower limit value; and the deformation degree of the piezoelectric layer 121 immediately after changing the reference voltage is the upper limit value. However, in order to shorten each change interval as a whole, the voltage may be changed at a time before the deformation degree has reached the lower limit value. Further, the deformation degree of the piezoelectric layer 121 immediately after each change may be smaller than the upper limit value.

Figure 10B:
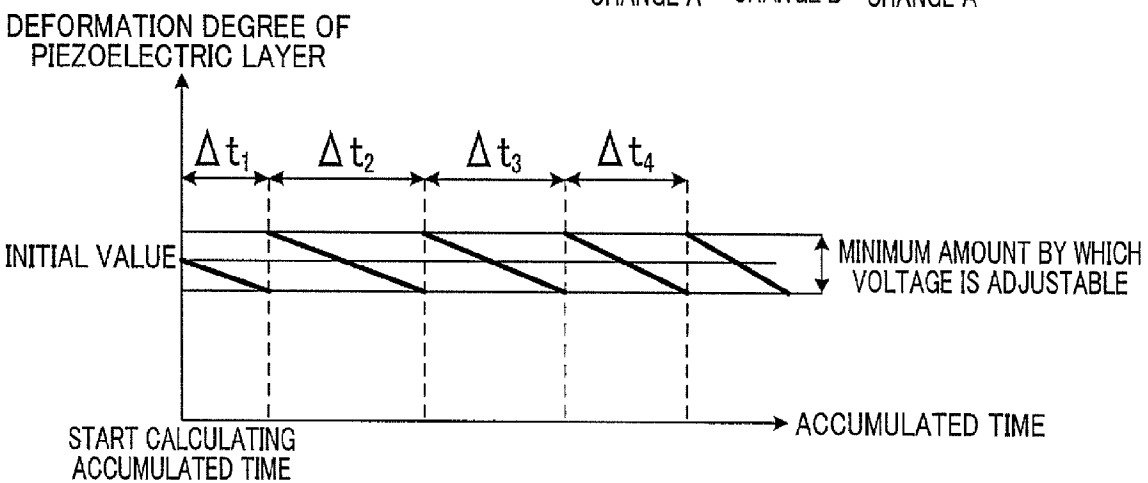
FIG. 10B is a graph showing how the degree of deformation of the piezoelectric layer varies in a modification where a condition for changing the reference voltage is modified.

Furthermore, due to a reason that the reference voltage is digitally-controlled, or the like, a minimum amount by which the voltage is adjustable, may be specified. In this instance, as shown in FIG. 10B, a difference in deformation degree between before and after a change of the reference voltage may be set so as to correspond to the minimum amount by which the reference voltage is adjustable (for example, 0.1V). This allows the change of the voltage to more precisely keep pace with the progress of deterioration of the piezoelectric layer 121.

A liquid ejection apparatus of the present invention is applicable not only to a printer but also to a facsimile, copying machine, or the like. Further, the number of heads in the liquid ejection apparatus is not limited to four, but may be any number of one or more. The head is not limited to a line head, but may be a serial head. Furthermore, the head related to the present invention may eject liquid other than ink.

What is claimed is:

1. A liquid ejection apparatus comprising:

a passage unit including an ejection opening which ejects liquid, and a supply passage which supplies the liquid to the ejection opening;

an piezoelectric actuator which includes a first electrode, a piezoelectric layer, and a second electrode arranged so that the first electrode and second electrode sandwich the piezoelectric layer therebetween, the piezoelectric actuator being configured so that, when a drive signal is applied between the first electrode and the second electrode, the piezoelectric layer is deformed and thereby energy is applied to the liquid in the supply passage;

a drive signal generator which generates a drive signal having a voltage value corresponding to a reference voltage value;

a driver which applies the drive signal generated by the drive signal generator between the first electrode and the second electrode;

a voltage value changing unit which changes the reference voltage value; and an interval setting unit which determines a time interval to a change of the reference voltage value made by the voltage value changing unit; wherein:

the voltage value changing unit changes the reference voltage value from a present voltage value to a larger voltage value, when an accumulated time during which a voltage is applied between the first electrode and the second electrode, the accumulated time being calculated since a last change of the reference voltage, reaches the time interval determined by the interval setting unit; and when the voltage value changing unit changes the reference voltage value, the interval setting unit determines another time interval which is shorter than before, based on the larger voltage value.

2. The liquid ejection apparatus according to claim 1, further comprising a thermometer which detects a temperature, wherein:

the drive signal generator generates a drive signal having a voltage value corresponding to the reference voltage value and to a temperature detected by the thermometer;

the interval setting unit determines a time interval corresponding to a statistical temperature obtained from temperatures detected since the last change of the reference voltage value and to the reference voltage value;

when the accumulated time reaches the thus determined time interval, (i) the voltage value changing unit changes the reference voltage value to a larger voltage value, and (ii) the interval setting unit determines another time interval which is shorter than before, based on the larger voltage value; and the lower the temperature detected by the thermometer is, the larger the voltage value of the drive signal generated by the drive signal generator is.

3. The liquid ejection apparatus according to claim 1, wherein an amount of change in the reference voltage value is constant in each change of the reference voltage value made by the voltage value changing unit.

4. The liquid ejection apparatus according to claim 3, wherein the amount of change is a minimum amount by which the voltage value changing unit is able to change the reference voltage value.

5. The liquid ejection apparatus according to claim 3, wherein the amount of change is larger than a minimum amount by which the voltage value changing unit is able to change the reference voltage value.

6. The liquid ejection apparatus according to claim 1, wherein the voltage value changing unit changes the reference voltage value so as to satisfy both of following conditions:

(i) the degree of deformation of the piezoelectric layer immediately after the last change of the reference voltage, the deformation caused by the drive signal, which has a voltage value corresponding to the reference voltage value changed in the last change, being applied between the first electrode and the second electrode, is substantially same as the degree of deformation of the piezoelectric layer immediately after a present change of the reference voltage value, the deformation caused by the drive signal, which has another voltage value corresponding to the reference voltage changed in the present change, being applied between the first electrode and the second electrode; and (ii) a difference between (a) the degree of deformation of the piezoelectric layer immediately before a change of the reference voltage value, the deformation caused by the drive signal, which has a voltage value corresponding to the reference voltage value before that change, being applied between the first electrode and the second electrode and (b) the degree of deformation of the piezoelectric layer immediately after that change, the deformation caused by the drive signal, which has another voltage value corresponding to the reference voltage value after that change, being applied between the first electrode and the second electrode, is substantially same in each change of the reference voltage value.

7. The liquid ejection apparatus according to claim 1, wherein the driver is configured to keep a voltage between the first electrode and the second electrode at a constant voltage value during a period between ejections of the liquid from the ejection opening; and when the liquid is ejected from the ejection opening, the driver applies the drive signal to cause the voltage between the first electrode and the second electrode to be zero once and then to cause the voltage to be returned to the constant voltage value.

* * * * *